United States Patent [19]

Schlüsselberger

[11] 4,324,587

[45] Apr. 13, 1982

[54] PROCESS FOR MAINTAINING MAGNESIUM-CONTAINING CAST IRON MELTS IN A CASTABLE STATE

[75] Inventor: Richard Schlüsselberger, Vienna, Austria

[73] Assignee: Elin-Union AG, Vienna, Austria

[21] Appl. No.: 189,167

[22] Filed: Sep. 22, 1980

[51] Int. Cl.[3] ..... C22C 33/08

[52] U.S. Cl. ..... 75/130 B; 75/53; 75/93 R; 75/96; 75/130 R

[58] Field of Search ..... 75/130 R, 53, 130 B, 75/96, 67, 93 R

[56] References Cited

U.S. PATENT DOCUMENTS 4,089,678 5/1978 Hanawalt ..... 75/67 A 4,214,899 7/1980 Radzilowski ..... 75/96

*Primary Examiner*—P. D. Rosenberg

*Attorney, Agent, or Firm*—Ernest F. Marmorek

[57] ABSTRACT

The present invention provides a process for maintaining magnesium-containing cast iron melts in a castable state for comparatively long periods of time of, for example, several hours or days, with the use of a protective gas atmosphere, wherein the protective gas atmosphere present above the surface of the melt, as well as all the adjacent parts of the apparatus used, is kept at a temperature above the boiling point of magnesium, i.e. 1102° C., and always has a partial pressure of magnesium vapor which is the same as or greater than the vapor pressure of the magnesium within the melt.

9 Claims, No Drawings

PROCESS FOR MAINTAINING MAGNESIUM-CONTAINING CAST IRON MELTS IN A CASTABLE STATE

The present invention is concerned with a process for maintaining magnesium-containing cast iron melts in a castable state for arbitrarily long periods of time.

In order to produce cast iron with spheroidal graphite, magnesium must be inroduced into the cast iron melt before casting. The magnesium first reacts with oxygen and sulphur present and, under certain circumstances, with other accompanying elements. A certain excess of free and active residual magnesium is important so that, in castings made from cast iron with spheroidal graphite, about 0.03 to 0.07% by weight of magnesium can be detected analytically.

In practice, it is necessary to treat comparatively large amounts of melt by introducing magnesium. Very often, the cast iron melts require a long time before the actual casting process is completed. The route from the place where the magnesium is introduced to the moulds can be very long or the casting process is automated so that magnesium-treated cast iron melts must be continuously available for comparatively long periods of time. Interruptions in the operations, which can result, for example, over the weekend or due to possible disturbances, also play a part in the case of these considerations.

However, magnesium-treated cast iron melts usually only retain the necessary magnesium content in the presence of air for a comparatively short period of time and as a rule for only up to about half an hour. The reason for this is that magnesium is very easily oxidised and reacts with the oxygen present in the air. On the other hand, because of its low boiling point of about 1102° C. (the temperature of the cast iron melt is usually about 1450° C.), magnesium has a high vapor pressure.

The problem of the oxidisability of magnesium has been previously circumvented by reducing the size of the surface area of the melt in the storage vessel and/or by using a protective gas. Furthermore, attempts have been successfully made to reduce the reaction of the magnesium with the cladding of the furnace or pan used by employing suitable stable additives, such as magnesium oxide or aluminum oxide. On the other hand, it has hitherto not been possible to prevent a reduction of the amount of the introduced magnesium because of its high vapour pressure.

Therefore, it is an object of the present invention to provide a process for maintaining magnesium-containing cast iron melts in a castable state for comparatively long periods of time in which, while overcoming the abovementioned problems with certainty, the necessary magnesium content of the cast iron melt is ensured.

Thus, according to the present invention, there is provided a process for maintaining magnesium-containing cast iron melts in a castable state for comparatively long periods of time of, for example, several hours or days, with the use of a protective gas atmosphere, wherein the protective gas atmosphere present above the surface of the melt, which is preferably an inert gas, as well as all the adjacent parts of the apparatus used, is kept at a temperature above the boiling point of magnesium, i.e. 1102° C., and always has a partial pressure of magnesium vapour which is the same as or greater than the vapour pressure of the magnesium within the melt.

In this way, it is possible to prevent vaporised magnesium condensing and thus to prevent the partial pressure decreasing.

According to a preferred embodiment of the present invention, the whole of the surface of the melt is kept in a closed furnace under a magnesium-containing inert gas atmosphere.

According to another preferred embodiment of the present invention, only a part of the surface of the melt is kept under a magnesium-containing inert gas atmosphere by means of the use of a diving bell-like device.

Thus, we have found that the introduction of magnesium into cast iron melts, which, as is known, can involve considerable difficulties, can, according to the process of the present invention, be accomplished solely from the gas phase.

It is also possible, when such a melt has to stand for several days, to permit the magnesium content of the melt to drop and again to produce the previous magnesium content shortly before casting by charging the inert gas phase with magnesium which is then taken up by the melt due to the higher partial pressure.

It is already known to introduce magnesium into cast iron melts in autoclaves (pressurised pans or pressurised chambers). However, in the case of the process according to the present invention, the melt is only under a small overpressure. The purpose of this is to be able to maintain the protective gas atmosphere even in case of leakage losses. Furthermore, in contradistinction to the autoclave processes, it is then possible continuously to take off melt. By means of a continuous and controlled addition of magnesium to the inert gas, there is produced the desired magnesium partial pressure over the melt.

The continuous charging of the protective gas with magnesium can be achieved, according to the present invention, by introducing finely-divided magnesium or magnesium-containing material into the inert gas atmosphere in the form of powder, grit, granules, pieces of wire or the like, preferably by means of an appropriate measuring device.

According to the further embodiment of the present invention, a wire of magnesium or magnesium-containing material can be introduced into the hot inert gas atmosphere from above or from the side, the wire then being melted and vaporised by the heat.

Furthermore, according to the present invention, the necessary amount of magnesium vapour for the inert gas atmosphere can be obtained from a melt container in communication therewith which contains magnesium or magnesium-containing material, the vaporising amount of magnesium being controllable by the heating capacity.

Finely-divided magnesium or magnesium-containing material can be introduced, for example, by means of the following device: a disc is rotatably mounted with only a small degree of play in a squat cylindrical housing, this disc being oscillatingly movable by means of a rotating cylinder. The disc is provided with two diametrically opposite cylindrical bores for the reception of a measured amount of magnesium. One of the two bores is, upon rotating, in the filling position, whereas the other is simultaneously in the emptying position in which the magnesium material is admixed with an inert gas current flowing therethrough. The magnesium melts and vaporises upon entering the furnace chamber. The amount of magnesium to be introduced can be regulated according to need or to the quantity of melt to be treated or maintained by altering the size of the bores by means of insertable rings and/or by varying the rhythm of the rotating cylinder.

When introducing magnesium vapour into the inert gas atmosphere, it can, for example, be advantageous to keep a small amount of magnesium or magnesium-containing material in a heatable container at a temperature close to the boiling point of magnesium. The amount of magnesium which is to vaporise in order to obtain the desired magnesium partial pressure in the inert gas atmosphere can be regulated by the energy supply to the melting vessel.

The following Examples are given for the purpose of illustrating the present invention:

EXAMPLE 1

A melt containing, by weight, 3.40% carbon, 2.30% silicon, 0.02% manganese, 0.015% phosphorus, 0.003% sulphur and 0.092% magnesium, the remainder being iron, is kept hot for a comparatively long period of time in an inductively heated holding furnace with a capacity of 440 kg. and with a magnesium oxide furnace lining. The furnace is closed by a cover and provided with devices for inroducing argon and for adding magnesium. When passing in argon in an amount corresponding to the rate of leakage of the furnace of 8 liters/minute, we have found, as can be seen from the following Table 1, that the magnesium content dropped from 0.092% by weight to 0.004% by weight within the course of 2 hours.

TABLE 1

| period of keeping hot in hours | 0 | 0.5 | 1 | 1.5 | 2 |
|---|---|---|---|---|---|
| wt. % magnesium | 0.092 | 0.042 | 0.028 | 0.012 | 0.004 |

If, on the other hand, by an appropriate addition of magnesium to the furnace chamber, a sufficient partial pressure of magnesium is produced and maintained, then the magnesium content of the melt increases within the course of 4 hours from 0.004% by weight to 0.043% by weight, as can be seen from the following Table 2:

TABLE 2

| period of keeping hot in hours | 0 | 1 | 2 | 3 | 4 |
|---|---|---|---|---|---|
| wt. % magnesium | 0.004 | 0.017 | 0.027 | 0.039 | 0.043 |

EXAMPLE 2

In the case of another melt, the magnesium content of which under argon has decreased from 0.145% by weight to 0.020% by weight in the course of 1.5 hours, by adding magnesium to the protective gas, a decrease of the magnesium content can be prevented by building up a sufficient partial pressure of magnesium over the melt and the magnesium content can be adjusted to about 0.03% by weight, as can be seen from the following Table 3:

TABLE 3

| period of keeping | without Mg addition | | | with Mg addition | | |
|---|---|---|---|---|---|---|
| hot in hours | 0 | 0.5 | 1.0 | 1.5 | 2.0 | 5.0 |
| wt. % magnesium | 0.145 | 0.058 | 0.034 | 0.020 | 0.026 | 0.030 |

Under the conditions present, in the case of a magnesium content of 0.019% by weight, satisfactory spheroidal graphite formation in the cast iron can already be achieved. In practice, a higher content of magnesium analysis value is usually necessary for a satisfactory cast iron with spheroidal graphite. When a melt is left to stand for a comparatively long period of time, inactive magnesium compounds, which are included in the magnesium analysis, precipitate out. For this reason, in the case of the process according to the present invention, a lower magnesium analysis value suffices.

The above two Examples show that it is possible, by adjustment of the magnesium partial pressure, to increase the magnesium content of the melt, from which it follows that a maintenance of the magnesium content is also possible over a comparatively long period of time. Thus, for example, in the case of a 20 tons holding furnace, it is possible to maintain the magnesium content at 0.05%±0.005% by weight for a period of 24 hours.

What is claimed is:

1. In a process for casting an iron-magnesium alloy in a closed furnace, the improvement in combination therewith comprising the steps of supplying a gas atmosphere from the outside into said furnace, said atmosphere comprising an inert gas and magnesium vapour to protect said magnesium-containing iron melt from oxidation, retaining said protective gas atmosphere above the surface of the melt, above the boiling point of magnesium of 1102° C., and maintaining at least as high a partial pressure of magnesium vapour in said protective atmosphere as said magnesium vapour pressure within said melt.

2. In a process as claimed in claim 1, wherein the gas-supplying step includes the step of introducing an inert gas into said furnace.

3. In a process as claimed in claims 1 or 2, wherein the gas-retaining step includes the step of maintaining said protective gas atmosphere only over a part of the surface of the melt.

4. In a process as claimed in claim 1, further including the step of introducing finely particulate magnesium material, or magnesium-containing material in the form of powder, grit, granules or wire into said protective atmosphere.

5. In a process as claimed in claim 4, wherein the material-introducing step includes the step of introducing the material at a predetermined rate.

6. In a process as claimed in claim 4, wherein said magnesium-containing material is introduced into said protective atmosphere from above.

7. In a process as claimed in claim 4, wherein said magnesium-containing material is laterally introduced into said protective atmosphere.

8. In a process as claimed in claims 1 or 2, wherein said pressure-maintaining step is carried out with the aid of a container having magnesium-containing material therein, and further comprising the step of keeping said container in communication with said protective atmosphere, and evaporating said material from said container into said atmosphere.

9. In a process as claimed in claim 7, wherein said furnace has a predetermined heat capacity, and further comprising the step of controlling the rate of evaporation of said material in dependence of said heat capacity.

* * * * *